US009772135B2

(12) United States Patent
Goodwin et al.

(10) Patent No.: US 9,772,135 B2
(45) Date of Patent: Sep. 26, 2017

(54) REFRIGERATOR DISPENSER WITH A FEEDBACK SIGNAL

(71) Applicant: Whirlpool Corporation, Benton Harbor, MI (US)

(72) Inventors: Kirk W. Goodwin, St. Joseph, MI (US); Vikas Malhotra, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 357 days.

(21) Appl. No.: 14/275,028

(22) Filed: May 12, 2014

(65) Prior Publication Data

US 2015/0084495 A1 Mar. 26, 2015

Related U.S. Application Data

(60) Provisional application No. 61/882,028, filed on Sep. 25, 2013.

(51) Int. Cl.
*B67D 1/00* (2006.01)
*F25C 5/00* (2006.01)

(52) U.S. Cl.
CPC ..... *F25C 5/005* (2013.01); *F25C 2400/10* (2013.01); *F25C 2600/02* (2013.01); *F25C 2600/04* (2013.01)

(58) Field of Classification Search
CPC .. F25C 5/005; F25C 2400/10; F25C 2600/04; F25C 2600/02; F25C 2700/10; F25C 2700/08; F25C 2700/00; F25C 2500/08
See application file for complete search history.

(56) References Cited

U.S. PATENT DOCUMENTS

| | | | | |
|---|---|---|---|---|
| 2004/0111182 | A1* | 6/2004 | Jeong | F25C 5/005 700/231 |
| 2007/0119204 | A1 | 5/2007 | Kwon | |
| 2010/0122751 | A1* | 5/2010 | Han | F25C 5/005 141/361 |
| 2010/0200621 | A1* | 8/2010 | Buchstab | F25C 5/005 222/638 |

FOREIGN PATENT DOCUMENTS

| | | | |
|---|---|---|---|
| DE | 20321896 | U1 | 4/2012 |
| EP | 2187152 | A2 | 5/2015 |
| EP | 2187153 | A2 | 5/2015 |

OTHER PUBLICATIONS

European Patent Application No. 14181836.9 filed Aug. 21, 2014, Applicant: Whirlpool Europe Srl, European Publication No. 2853845, mail date: Apr. 10, 2015 re: same.

* cited by examiner

*Primary Examiner* — Patrick M Buechner

(57) ABSTRACT

Example dispensers, refrigerators and methods to dispense objects are disclosed. A disclosed example dispenser includes a discharging lever to turn on/off discharge of the objects, a discharging shutter to open a discharging hole through which the objects are discharged, a discharge shutter driving part to operate the discharging shutter, a discharge driving part to discharge the objects, and a controller to sense a feedback signal from the discharge shutter driving part, and control the discharge driving part in response to the sensed feedback signal.

14 Claims, 6 Drawing Sheets

REFRIGERATOR DISPENSER WITH A FEEDBACK SIGNAL

RELATED APPLICATION(S)

This application claims the priority benefit of U.S. Provisional Patent Application No. 61/882,028, entitled "Dispensers, Refrigerators and Methods for Dispensing Objects," and filed on Sep. 25, 2013, which is incorporated herein by reference in its entirety.

FIELD OF THE DISCLOSURE

This disclosure relates generally to refrigerators, and, more particularly, to dispensers, refrigerators and methods to dispense objects.

BACKGROUND

Generally, a device that discharges objects such as a beverage, ice, etc., is called a dispenser. Recently, the dispenser has become widely used in refrigerators. FIG. 1 is an isometric view of a refrigerator 100 having a dispenser 105. As shown in FIG. 1, the refrigerator 100 comprises a main cabinet 1 partitioned into a refrigerating compartment and a freezing compartment, having front openings, and a refrigerating compartment door 2 and a freezing compartment door 3 opening/closing the respective front openings of the refrigerating and freezing compartments. The freezing compartment door 3 is provided with the dispenser 105, including a discharging lever 4 to be operated for obtaining ice made inside the freezing compartment.

A conventional dispenser includes a motor employed in discharging ice, a switching part to be turned on/off by the discharging lever 4, and a controller to control the motor to operate or stop according to the on or off state of the switching part.

The dispenser also includes a discharging shutter provided in the freezing compartment door 3, to selectively expose and cover a discharging hole through which the ice is discharged. The discharging shutter is opened in response to the activation of the discharging lever 4. Opening of the discharging shutter may be physically interlocked with the rotation of the discharging lever 4, and closing of the discharging shutter is electrically controlled by the controller. The controller may control a valve relay, and thus operate a solenoid valve, thereby causing the discharging shutter to cover the discharging hole once, for example, five seconds have passed since the switching part is turned off.

In the conventional dispenser, the rotation of the discharging lever 4 causes both the switching part, for operating the motor, and the discharging shutter to be simultaneously turned on and opened, respectively. However, it is possible that the switching part may not be turned on as the discharging lever is rotated, even though the discharging shutter is opened. In this case, the controller cannot operate the solenoid valve because no indication of the subsequent off state of the switching part is sent to the controller. Therefore, the discharging shutter does not cover the discharging hole, which allows frost to be deposited around the discharging hole.

Conversely, it is possible that the discharging shutter is not completely opened though the switching part is turned on as the discharging lever 4 is rotated. In this case, the controller senses the on state of the switching part and controls the motor to push the ice toward the discharging hole, but the ice is blocked by the discharging shutter, thereby allowing frost to be deposited around the discharging hole.

Accordingly, in some conventional examples, the motor is activated after a predetermined period has elapsed from the start of opening the discharging shutter. Additional and/or alternative a switch may be activated once the discharging shutter reaches its open state, and activation of the motor begins following activation of the switch.

DETAILED DESCRIPTION

Figure 1:
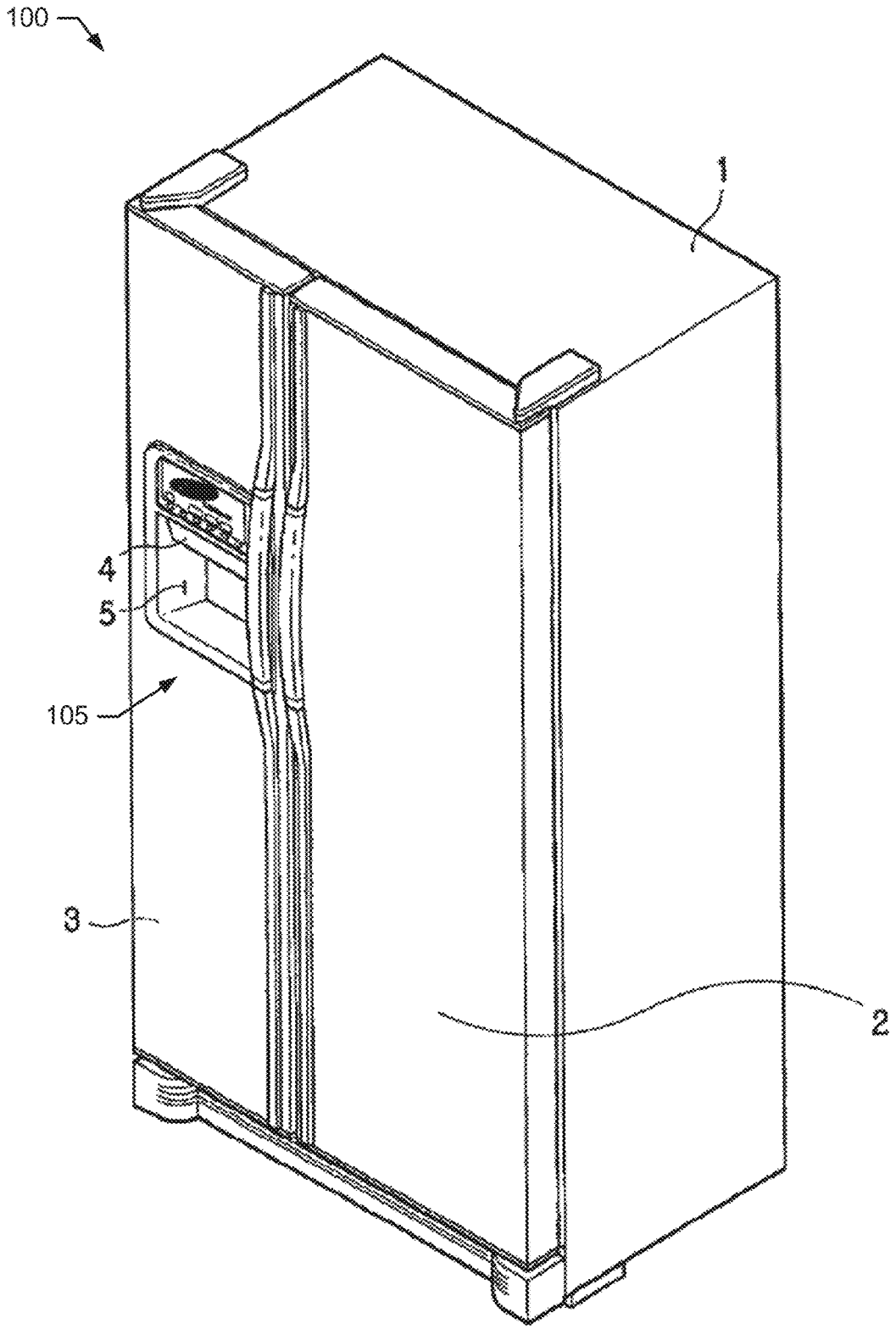
FIG. 1 (Prior Art)
FIG. 1 is an isometric view of an example prior art refrigerator.

It is an object of the examples disclosed herein to overcome at least the above problems. It is desirable to first activate a flapper covering part of a dispensing path from an ice bin to an external dispenser before activating an auger in the ice bin. The examples disclosed herein obtain at least the above objects by using a flapper motor feedback signal to determine when and/or if the flapper has reached its full open position before activating the auger. An advantage provided by the disclosed examples is that they allow for a stuck flapper not activating the auger as the feedback signal between starting the motor won't change unless the flapper is unstuck. Another advantage is that the flapper motor can be pulsed when a stuck condition is detected to assist in freeing the flapper.

Reference will now be made in detail to embodiments of this disclosure, examples of which are illustrated in the accompanying drawings, wherein like reference numerals refer to like elements throughout. The embodiments are described below by referring to the figures. Here, general configurations of a refrigerator according to the disclosure will be described with reference to FIG. 1. While the examples disclosed herein are described and illustrated with reference to a side-by-side refrigerator, those of ordinary skill in the art will recognize that the dispensers disclosed herein may be implemented in, for example, french-door bottom-mount refrigerators and other configurations of refrigerators having ice and water dispensers.

As show in FIG. 1, a refrigerator 100 in which embodiments of this disclosure may be implemented includes the main cabinet 1 partitioned into the refrigerating compartment and the freezing compartment, having front openings, and the refrigerating compartment door 2 and the freezing compartment door 3 respectively opening/closing the respective front openings of the refrigerating and freezing compartments. The freezing compartment door 3 is provided with a dispenser 105, including a discharging lever 4 to be operated for obtaining ice made inside the freezing compartment.

In the front of the freezing compartment door 3 is formed a dispensing part 5, which is recessed to accommodate a container to receive discharged objects such as ice. The discharging lever 4 is rotated forward and backward inside the dispensing part 5.

Figure 2:
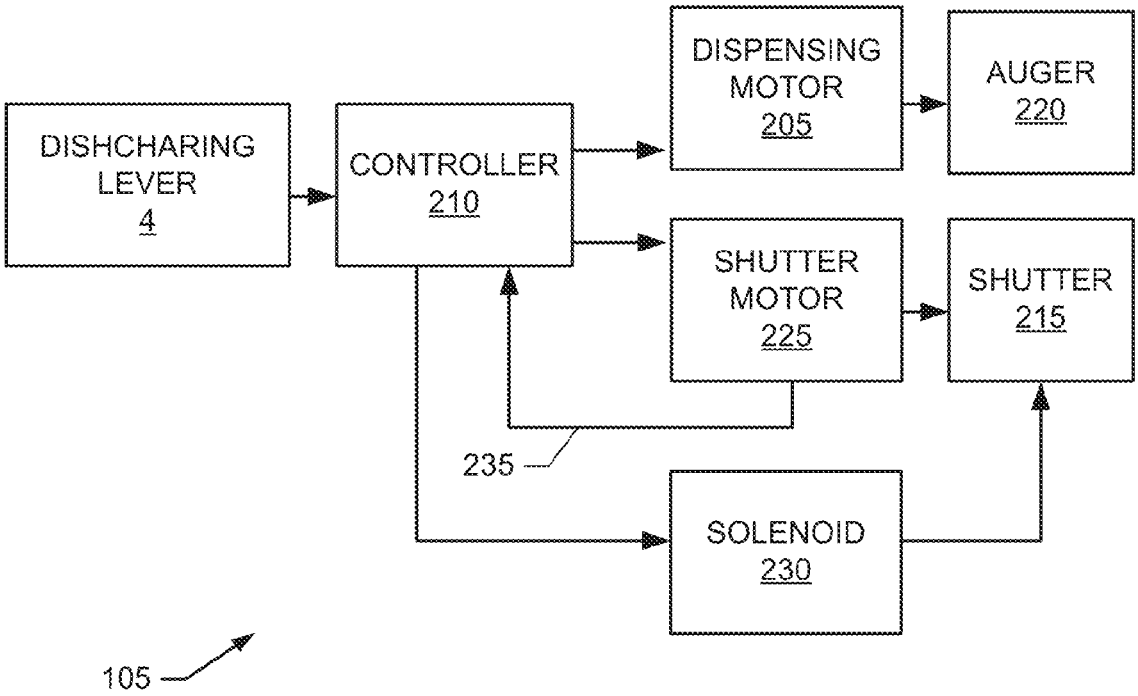
FIG. 2 is a block diagram of an example dispenser according to an embodiment of the disclosure.

FIG. 2 is a block diagram of an example manner of implementing the dispenser 105 of FIG. 1, according to an embodiment of this disclosure. To dispense objects, such as ice, the example dispenser 105 of FIG. 2 includes a driving part, e.g., a dispensing motor 205, to discharge objects such as ice, the discharging lever 4 to trigger operation of the motor 205, and a controller 210 to sense the on or off state of the dispensing lever 4 and to responsively control the motor 205, causing the motor 205 to operate or stop. Activation of ice discharge occurs when the discharging lever 4 is pushed inwardly in the dispensing part 5 by a user until rotated beyond a predetermined angle, and is turned off when the discharging lever 4 is returned to its original position.

The operation of the dispensing motor 205 is controlled by the controller 210, so that ice stored in the freezing compartment is moved toward the discharging hole provided in or in conjunction with the freezing compartment door 3. In this embodiment, the dispensing motor 205 and an auger 220 is employed as the driving part. However, other driving parts, such as a reciprocating piston, may be employed for moving ice toward the discharging hole.

The example dispenser 105 of FIG. 2 includes a discharging shutter 215 provided in or in conjunction with the freezing compartment door 3 to expose and cover a discharging hole (not shown) through which the ice is discharged, and the auger 220 driven by the dispensing motor 205 to cause ice to pass through the discharging hole.

To operate the discharging shutter 215, the example dispenser 105 of FIG. 2 includes a discharging shutter motor 225, and a solenoid valve 230. The controller 210 operates the discharging shutter motor 225 to move the shutter 215 from a closed position to an open position. The controller 210 triggers the solenoid 230 to release the discharging shutter 215 from the opened state to cover the discharging hole.

To enable the controller 210 to determine the state of the shutter 215, the example shutter motor 225 of FIG. 2 provides one or more feedback signals 235 to the controller 210. Example feedback signals 235 include, but are not limited to, a voltage, a current, a torque and/or a revolutions per minute. The example controller 210 uses the feedback signal(s) 235 to detect when the shutter 215 is open such that the controller 210 can start the dispensing motor 205.

Figure 3:
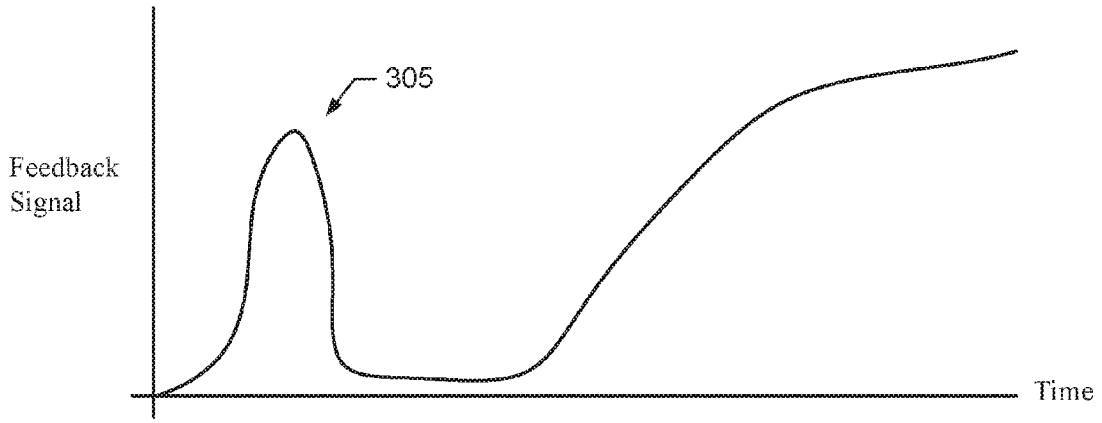
FIGS. 3 and 4 are graphs illustrating example feedback from the example shutter motor of FIG. 2.
Figure 4:
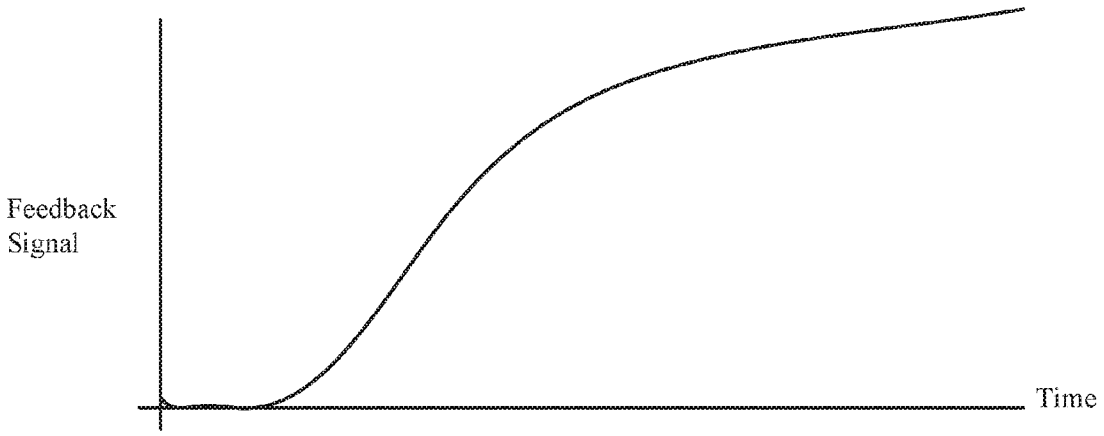

FIGS. 3 and 4 are example graphs illustrating an example feedback signal 235 due to operation of the shutter motor 225. In FIG. 3, there is an initial transient 305 associated with startup of the shutter motor 225. The example transient 305 of FIG. 3 may represent a momentary increase in voltage, current or torque associated with an initial movement of the shutter 215. After the initial transient 305, the feedback signal 235 increases as the shutter 215 is driven against its open position. This increase in the feedback signal 235 can be used by the controller 210 to detect when the shutter 215 is open and, thus, when to start the dispensing motor 205.

In some instances, such as that shown in FIG. 4, there will not be an initial transient. Such circumstances may be indicative of a shutter 215 that will not open due to, for example, frost and/or ice that has formed on the shutter 215. Accordingly, the controller 210 can detect the lack of an initial transient and refrain from starting the dispensing motor 205.

Figure 5:
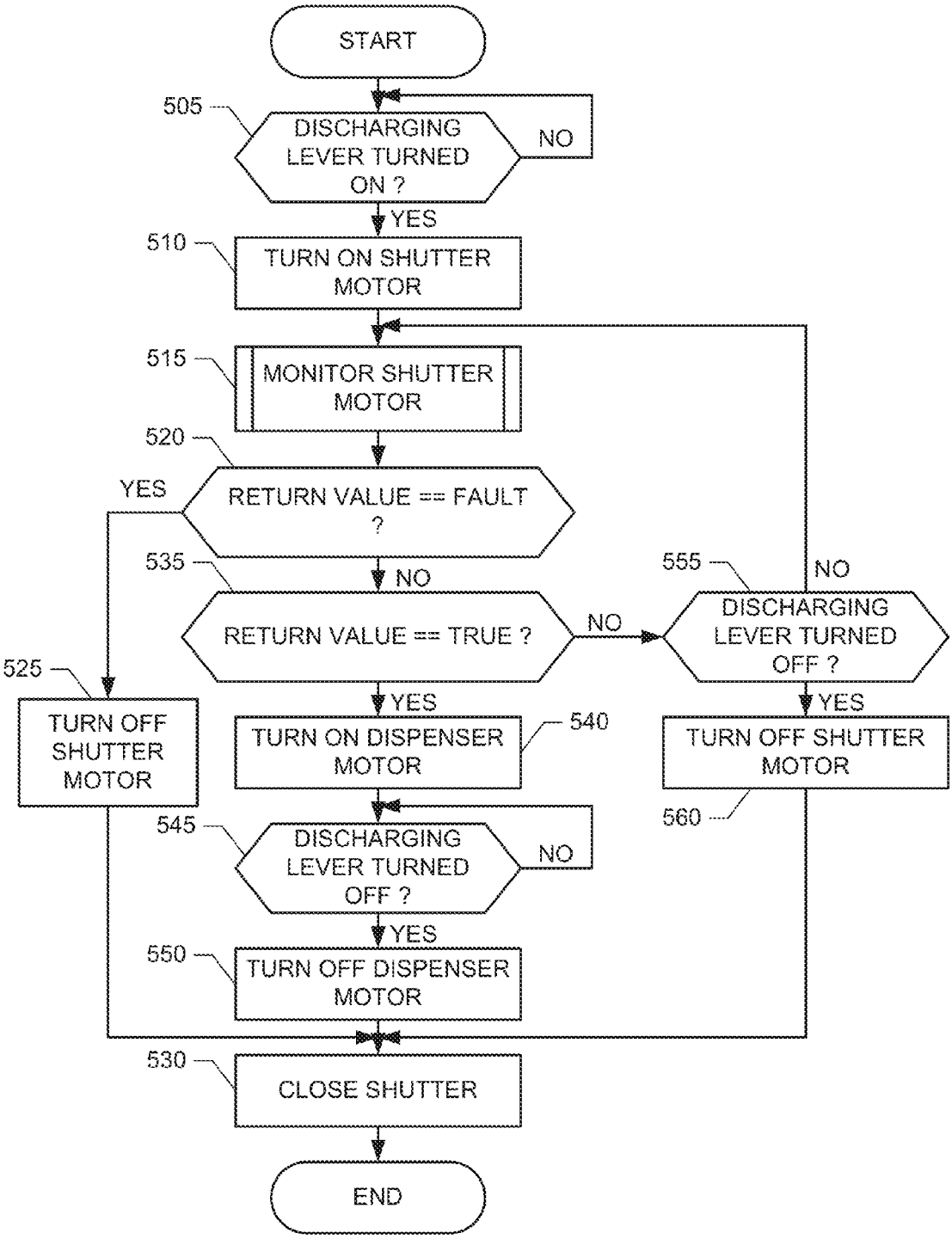
FIGS. 5 and 6 are flowcharts illustrating example processes that may, for example, be implemented using machine-readable instructions executed by one or more processors to implement the example controller of FIG. 2.
Figure 6:
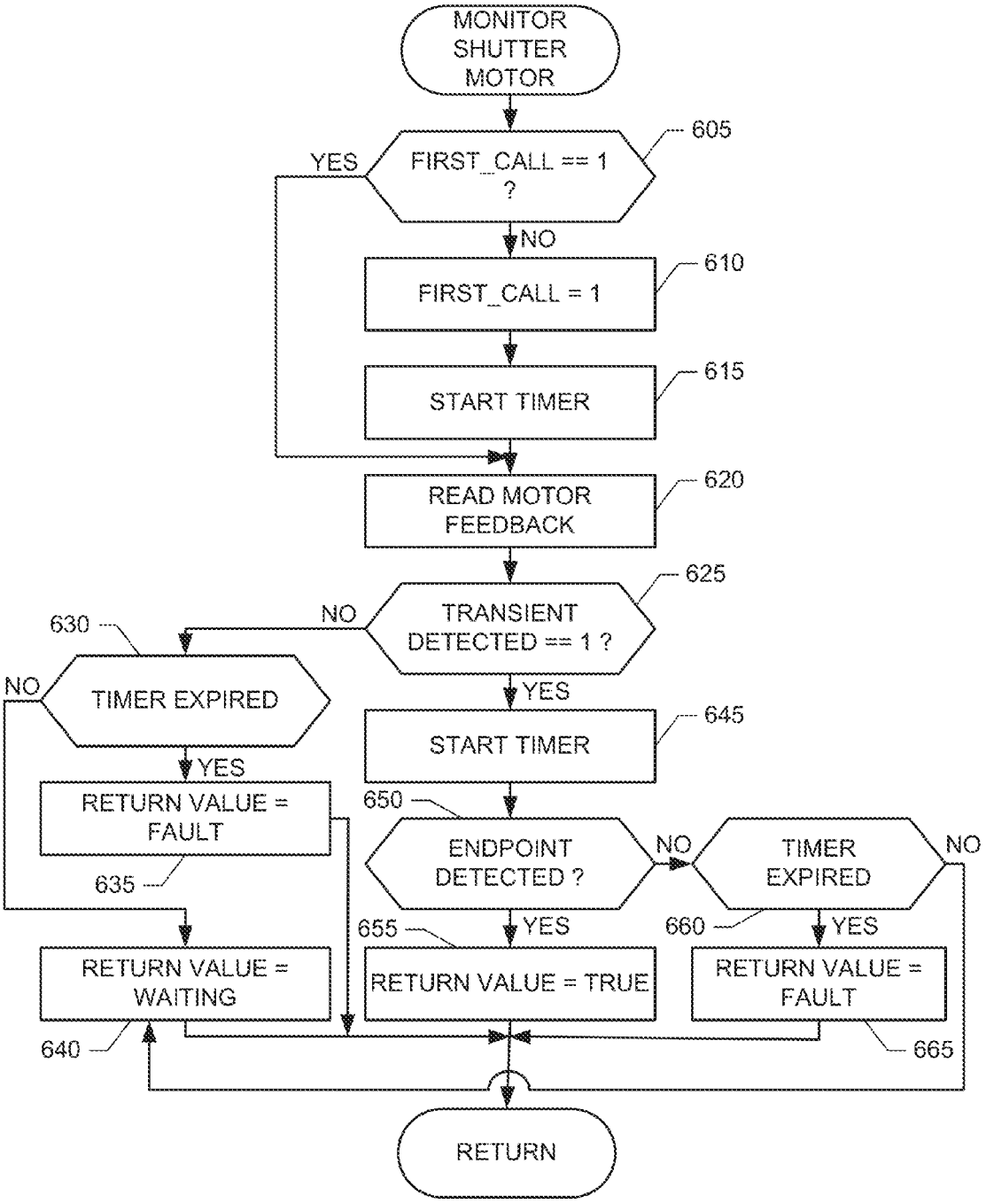

FIGS. 5 and 6 are flowcharts of an example process that may, for example, be implemented as machine-readable instructions carried out by one or more processors to implement the example controller 210 of FIG. 2. The example machine-readable instructions of FIG. 5 begin with the example controller 210 determining whether the discharging lever 4 has been activated (block 505). When the discharging lever 4 has been activated (block 505), the controller 210 activates the shutter motor 225 (block 510) and begins monitoring the feedback signal(s) 235 from the shutter motor 225 using, for example, the example process of FIG. 6 (block 515).

If the value returned from the example process of FIG. 6 is "FAULT" (block 520), the controller 210 turns off the shutter motor 225 (block 525) and activates the solenoid 230 to close the shutter 215 (block 530). Control then exits from the example process of FIG. 5.

Returning to block 520, if the returned value is "TRUE" meaning the feedback signal(s) 235 from the shutter motor 225 indicate the shutter 215 is open (block 535), the controller 210 turns on the dispensing motor 205 (block 540). When the discharging lever 4 is returned to the off position (block 545), the controller 210 turns off the dispensing motor 205 (block 550) and activates the solenoid 230 to close the shutter 215 (block 530). Control then exits from the example process of FIG. 5.

Returning to block 535, if the returned value is not "FAULT" or "TRUE" (block 535), the controller 210 determines whether the discharging lever 4 is still in the on state (block 555). If discharging lever 4 is in the on state (block 555), control returns to block 515 to monitor the state of the shutter motor 225. If the discharging lever 4 is in the off state (block 555), the controller 210 turns off the shutter motor 225 (block 560) and activates the solenoid 230 to close the shutter 215 (block 530). Control then exits from the example process of FIG. 5.

Turning to FIG. 6, the example machine-readable instructions of FIG. 6 may be executed and/or carried out to monitor the shutter motor 225. The controller 210 determines whether this is the first call after activation of the shutter motor 225 (block 605). If it is the first call, a first call flag is set (block 610) and a timer is started (block 615).

The controller 210 reads and senses the feedback signal(s) 235 (block 620) and determines whether an initial transient has been detected (block 625). When a transient has not yet been detected (block 625), the controller 210 checks whether the timer has expired (block 630). If the timer has expired (block 630), a value of "FAULT" is returned (block 635) and control returns from the example process of FIG. 6 to, for example, to the example process of FIG. 5 at block 520. Returning to block 630), if the timer has not expired, a value of "WAITING" is returned (block 640) and control returns from the example process of FIG. 6 to, for example, to the example process of FIG. 5 at block 520.

Returning to block 625, if a transient has been detected (block 625), the controller 210 starts a timer (block 645). If a feedback signal(s) 235 indicative of the shutter 215 being open is detected (block 650), a value of "TRUE" is returned (block 655) and control returns from the example process of FIG. 6 to, for example, to the example process of FIG. 5 at block 520.

If a feedback signal(s) 235 indicative of the shutter 215 being open has not been detected (block 650), the controller 210 determines whether the timer has expired (block 660).

If the timer has not expired (block 660), control proceeds to block 640 to return a value of "WAITING." If the timer has expired (block 660), a value of "FAULT" is returned (block 665) and control returns from the example process of FIG. 6 to, for example, to the example process of FIG. 5 at block 520

A processor, a controller and/or any other suitable processing device may be used, configured and/or programmed to execute and/or carry out the example machine-readable instructions of FIGS. 5 and 6. For example, the example processes of FIGS. 5 and 6 may be embodied in program code and/or machine-readable instructions stored on a tangible computer-readable medium accessible by a processor, a computer and/or other machine having a processor such as the example processor platform P100 of FIG. 7. Machine-readable instructions comprise, for example, instructions that cause a processor, a computer and/or a machine having a processor to perform one or more particular processes. Alternatively, some or all of the example machine-readable instructions of FIGS. 5 and 6 may be implemented using any combination(s) of fuses, application-specific integrated circuit(s) (ASIC(s)), programmable logic device(s) (PLD(s)), field-programmable logic device(s) (FPLD(s)), field programmable gate array(s) (FPGA(s)), discrete logic, hardware, firmware, etc. Also, some or all of the example machine-readable instructions of FIGS. 5 and 6 may be implemented manually or as any combination of any of the foregoing techniques, for example, any combination of firmware, software, discrete logic and/or hardware. Further, many other methods of implementing the example process of FIGS. 5 and 6 may be employed. For example, the order of execution may be changed, and/or one or more of the blocks and/or interactions described may be changed, eliminated, sub-divided, or combined. Additionally, any or the entire example machine-readable instructions of FIGS. 5 and 6 may be carried out sequentially and/or carried out in parallel by, for example, separate processing threads, processors, devices, discrete logic, circuits, etc.

As used herein, the term "tangible computer-readable medium" is expressly defined to include any type of computer-readable medium and to expressly exclude propagating signals. As used herein, the term "non-transitory computer-readable medium" is expressly defined to include any type of computer-readable medium and to exclude propagating signals. Example tangible and/or non-transitory computer-readable medium include, but are not limited to, a volatile and/or non-volatile memory, a volatile and/or non-volatile memory device, a compact disc (CD), a digital versatile disc (DVD), a floppy disk, a read-only memory (ROM), a random-access memory (RAM), a programmable ROM (PROM), an electronically-programmable ROM (EPROM), an electronically-erasable PROM (EEPROM), an optical storage disk, an optical storage device, magnetic storage disk, a network-attached storage device, a server-based storage device, a shared network storage device, a magnetic storage device, a cache, and/or any other storage media in which information is stored for any duration (e.g., for extended time periods, permanently, brief instances, for temporarily buffering, and/or for caching of the information) and which can be accessed by a processor, a computer and/or other machine having a processor, such as the example processor platform P100 discussed below in connection with FIG. 4.

Figure 7:
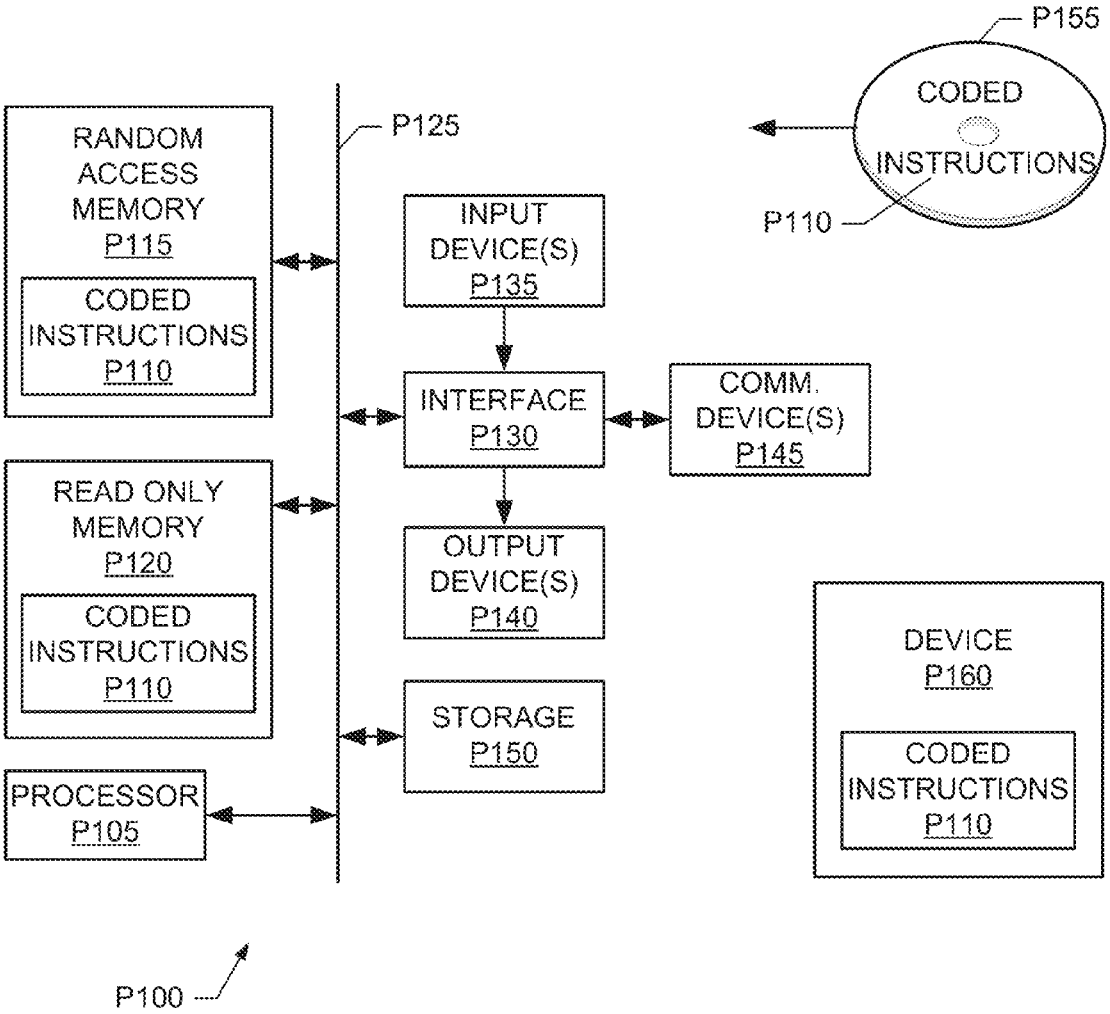
FIG. 7 is a schematic illustration of an example processor platform that may be used and/or programmed to implement the example controller of FIG. 2 and/or to execute the example machine-readable instructions of FIGS. 5 and 6.

FIG. 7 illustrates an example processor platform P100 capable of executing the example instructions of FIGS. 5 and 6 to implement the example controller 210 of FIG. 2. The example processor platform P100 can be, for example, any type of computing device containing a processor.

The processor platform P100 of the instant example includes at least one programmable processor P105. For example, the processor P105 can be implemented by one or more Intel®, AMD®, and/or ARM® microprocessors. Of course, other processors from other processor families and/or manufacturers are also appropriate. The processor P105 executes coded instructions P110 present in main memory of the processor P105 (e.g., within a volatile memory P115 and/or a non-volatile memory P120), stored on a storage device P150, stored on a removable computer-readable storage medium P155 such as a CD, a DVD, a floppy disk and/or a FLASH drive, and/or stored on a communicatively coupled device P160 such as an external floppy disk drive, an external hard disk drive, an external solid-state hard disk drive, an external CD drive, an external DVD drive a server, a network-attached storage device, a server-based storage device, and/or a shared network storage device. The processor P105 may execute, among other things, the example machine-readable instructions of FIGS. 5 and 6. Thus, the coded instructions P110 may include the example instructions of FIGS. 5 and 6.

In some examples, one or more of the storage devices P150, the removable storage medium P155 and/or the device P160 contains, includes and/or stores an installation package and/or program including the machine-readable instructions of FIGS. 5 and 6 and/or the coded instructions P110.

The processor P105 is in communication with the main memory including the non-volatile memory P120 and the volatile memory P115, and the storage device P150 via a bus P125. The volatile memory P115 may be implemented by Synchronous Dynamic Random Access Memory (SDRAM), Dynamic Random Access Memory (DRAM), RAMBUS® Dynamic Random Access Memory (RDRAM) and/or any other type of RAM device(s). The non-volatile memory P120 may be implemented by flash memory(-ies), flash memory device(s) and/or any other desired type of memory device(s). Access to the memory P115 and P120 may be controlled by a memory controller.

The processor platform P100 also includes an interface circuit P130. Any type of interface standard, such as an external memory interface, serial port, general-purpose input/output, as an Ethernet interface, a universal serial bus (USB), and/or a PCI express interface, etc, may implement the interface circuit P130.

One or more input devices P135 are connected to the interface circuit P130. The input device(s) P135 permit a user to enter data and commands into the processor P105. The input device(s) P135 can be implemented by, for example, a keyboard, a mouse, a touchscreen, a track-pad, a trackball, an isopoint and/or a voice recognition system.

One or more output devices P140 are also connected to the interface circuit P130. The output devices P140 can be implemented, for example, by display devices (e.g., a liquid crystal display, a cathode ray tube display (CRT), a printer and/or speakers). The interface circuit P130, thus, typically includes a graphics driver card.

The interface circuit P130 may also includes one or more communication device(s) P145 such as a network interface card to facilitate exchange of data with other computers, nodes and/or routers of a network.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A dispenser to discharge objects, comprising:

a discharging lever to turn on/off discharge of the objects;

a discharging shutter to open a discharging hole through which the objects are discharged;

a discharge shutter driving part to operate the discharging shutter;

a discharge driving part to discharge the objects; and a controller to sense a feedback signal from the discharge shutter driving part, and control the discharge driving part in response to the sensed feedback signal;

wherein the controller initiates the discharge driving part after detecting an initial transient in an amplitude of the feedback signal, a drop in amplitude below a maximum transient amplitude detected during the initial transient, and an increase in feedback signal amplitude greater than the maximum transient amplitude of the sensed feedback signal.

2. The dispenser according to claim 1, further comprising a solenoid valve to release the discharging shutter from an opened state to make the discharging shutter cover the discharging hole.

3. The dispenser according to claim 1, wherein the controller is to control the discharge driving part to stop in response to the discharging lever being turned off.

4. The dispenser according to claim 1, wherein the discharge shutter driving part comprises a motor, and the feedback signal represents at least one of a current or a voltage.

5. The dispenser according to claim 1, wherein the discharge shutter driving part comprises a motor, and the feedback signal represents a torque.

6. The dispenser according to claim 1, wherein the discharge shutter driving part comprises a motor, and the feedback signal represents a revolution speed.

7. The dispenser according to claim 1, wherein the discharge driving part comprises an auger.

8. The dispenser according to claim 1 wherein the controller detects a lack of an initial transient in the feedback signal prior to the amplitude of the feedback signal exceeding a predetermined value and refrains from initiating the discharge driving part.

9. A refrigerator comprising:

a main cabinet including at least one storage compartment having a front opening;

a door opening and closing the front opening of the storage compartment; and a dispenser to discharge objects, the dispenser including a discharging lever to turn on/off discharge of the objects, a discharging shutter to open a discharging hole through which the objects are discharged, a discharge shutter driving part to operate the discharging shutter, a discharge driving part to discharge the objects, and a controller to sense a feedback signal from the discharge shutter driving part, and control the discharge driving part in response to the sensed feedback signal;

wherein the controller initiates the discharge driving part after detecting an initial transient in an amplitude of the feedback signal, a drop in amplitude below a maximum transient amplitude detected during the initial transient, and an increase in feedback signal amplitude greater than the maximum transient amplitude of the sensed feedback signal.

10. The refrigerator according to claim 9, wherein the discharge shutter driving part comprises a motor, and the feedback signal represents at least one of a current or a voltage.

11. The refrigerator according to claim 9, wherein the discharge shutter driving part comprises a motor, and the feedback signal represents a torque.

12. The refrigerator according to claim 9, wherein the discharge shutter driving part comprises a motor, and the feedback signal represents a revolution speed.

13. The refrigerator according to claim 9, wherein the discharge driving part comprises an auger.

14. The refrigerator according to claim 9 wherein the controller detects a lack of an initial transient in the feedback signal prior to the amplitude of the feedback signal exceeding a predetermined value and refrains from initiating the discharge driving part.

* * * * *